United States Patent [19]

Takagiwa et al.

[11] Patent Number: 4,877,704

[45] Date of Patent: Oct. 31, 1989

[54] PROCESS FOR DEVELOPING LATENT ELECTROSTATIC IMAGE USING TONER CONTAINING POLYESTER RESIN

[75] Inventors: Hiroyuki Takagiwa, Hachioji; Jiro Takahashi, Sagamihara; Meizo Shirose, Hino; Kunio Akimoto, Fujisawa; Masafumi Uchida, Hachioji, all of Japan

[73] Assignee: Konishiroku Photo Industry Co., Ltd., Tokyo, Japan

[21] Appl. No.: 191,790

[22] Filed: Apr. 28, 1988

Related U.S. Application Data

[63] Continuation of Ser. No. 73,835, Jul. 15, 1987, abandoned, which is a continuation of Ser. No. 740,176, May 31, 1985, abandoned.

[30] Foreign Application Priority Data

May 31, 1984 [JP] Japan ..... 59-109543
May 31, 1984 [JP] Japan ..... 59-109544
May 31, 1984 [JP] Japan ..... 59-109545

[51] Int. Cl.[4] ..... G03G 13/20

[52] U.S. Cl. ..... 430/99; 430/109; 430/904; 430/124

[58] Field of Search ..... 430/109, 99, 124, 904

[56] References Cited

U.S. PATENT DOCUMENTS

| | | | |
|---|---|---|---|
| 2,297,691 | 10/1942 | Carlson | 430/31 X |
| 3,510,338 | 5/1970 | Varron | 430/120 |
| 3,590,000 | 6/1971 | Palermiti et al. | 430/904 X |
| 3,951,835 | 4/1976 | Tomomo et al. | 430/110 X |
| 4,099,968 | 7/1978 | Scouten et al. | 430/107 |

FOREIGN PATENT DOCUMENTS 2100873 1/1983 United Kingdom .

*Primary Examiner*—J. David Welsh
*Attorney, Agent, or Firm*—Frishauf, Holtz, Goodman & Woodward

[57] ABSTRACT

Toner for developing an electrostatic latent image comprising (a) a polyester resin of a non-linear copolymer having, as its side chain, an aliphatic hydrocarbon group containing therein 3 to 22 carbon atoms, said copolymer being obtained from polymerization of an etherified bisphenol monomer, a di-carboxilic acid monomer, and a polyhydric alcohol of tri-hydric or more and/or a monomer component containing a polycarboxylic acid monomer of tricarboxylic acid or more carboxylic or more, and at least one compound selected from the group consisting of (b) an alkylene-bis-aliphatic acid amide compound represented by the general formula;

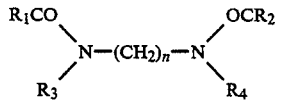

wherein $R_1$ and $R_2$ are independently selected from saturated or unsaturated aliphatic hydrocarbon groups having not less than 10 carbon atoms, $R_3$ and $R_4$ are independently selected from a hydrogen atom and a group represented by $—OCR_5$ wherein $R_5$ is a saturated or unsaturated hydrocarbon group and n is a positive integer and (c) a wax containing not less than 20% by weight of ester component, the needle penetration degree of wax being not more than 4.

21 Claims, No Drawings

PROCESS FOR DEVELOPING LATENT ELECTROSTATIC IMAGE USING TONER CONTAINING POLYESTER RESIN

This application is a continuation of application Ser. No. 073,835, filed July 15, 1987, now abandoned which in turn is a continuation of Ser. No. 740,176 filed May 31, 1985, now abandoned.

FIELD OF THE INVENTION

The present invention relates to a toner for developing an electrostatic latent image formed in electrophotography, electrostatic recording, electrostatic printing, etc.

BACKGROUND OF THE INVENTION

Image formation process in electrophotography generally comprises a step of forming an electrostatic latent image by uniformly charging and, thereafter, imagewise exposing a photoconductive photoreceptor, a step of developing thus formed electrostatic latent image with a toner, which is formed of a fine resin powder containing therein a colorlant, etc., a step of transferring thus formed toner image onto a transferee such as transfer paper, and a step of fixing the toner image by means of heating, pressurizing, etc., to obtain a visualized image.

The image forming process making use of the electrostatic latent image should preferably be performed as quick as possible, and in this view, the heat roll fixing process, which has better heat efficiency and other advantages in comparison with other fixing processes of the art, has been widely applied in this field.

Recently, however, further speed-up of the total image formation process is strongly demanded, and for the attainment of this purpose, it becomes essential for the fixing step to be speeded up. For the fixing of toner to be carried out at higher speed in the heat roll fixing method, the toner for the development is required to have a fixability at lower temperature, and for this purpose, the binder resin to be used should necessarily have a lower softening point. However, in general, when the softening point of the binder resin of a toner is lowered, a part of the toner image tends to be transferred to the surface of the heat roll and thus transferred toner is re-transferred to the surface of the subsequent transfer sheet, which is so-called an off-set phenomenon, to cause deterioration in the toner image. In addition, in the heat roll fixing method there is a tendency that a transfer sheet easily winds round the surface of the heat roll, which is so-called a winding penomenon. This winding phenomenon is likely to take place especially when the temperature of the heat roll is too low.

For the purpose of preventing the off-set or the winding phenomenon from taking place, various measures have been proposed and some of them have been put into practice. As one of such measures, it has been proposed that fixing be carried out while providing to and coating the surface of heat roll with a mold releasing oil such as silicone oil. The another proposed measure is to confer the toner itself with mold releasing property and thus to give it the off-set prevention property. The latter measure has an advantage over the former that no oil providing system in the copying machine is necessary and, therefore, the structure of a fixing unit could be made simpler and that no maintenance, such as repleniching of silicone oil, is needed, etc.

As for the means for conferring the toner itself with good off-set prevention property there has been proposed a method of (a) using as a binder resin for the toner a polymer having high molecular weight, or (b) incorporating a mold releasing compound into the toner. However, by means of method (a), although the off-set prevention property of the toner may be improved, due to the rise of the softening point of the resin, it becomes difficult to carry out fixing operation at low temperature.

Recently as a binder resin having low softening point, polyester resin has been drawn attention. By the use of a polyester resin, as low molecular weight resin being readily obtainable, it is possible to obtain a toner having relatively low softening point. The toner using the polyester resin as a binder has, in comparison with the toner in which a vinyl-type polymer is used, such an advantage that it has better wetting property against a transfer sheet such as paper and, therefore, fixing at lower temperature becomes possible comparing with the case where a vinyl-type polymer having approximately the same softening point is used.

On the other hand, as for method (b), wherein toner is incorporated with a mold releasing agent, it has been proposed, as disclosed in Japanese Patent Publication No. 3304/1977 or 3305/1977, to use as a mold releasing agent a polyolefin wax such as a polypropylene or polyethylene. It is generally effective to use such mold releasing agent, however, in order to make a toner having sufficient off-set prevention and winding prevention properties as well as wide practical fixing temperature range, the proportion of the mold releasing agent to be incorporated must be increased to a considerable extent. However, with the increace of the proportion of such mold releasing agent in the toner, fluidity of the toner powder comes to be lowered, and as the result, satisfactory development becomes difficult despite of the improvement in the fixing operation and it becomes difficult to obtain an toner image of good image quality.

Further, with the use of a toner containing a polyolefin wax, there has been observed a disadvantage that, when such toner is used together with carrier particles in a so-called two-component developer, the carrier particles are liable to wear out easily and the effective life time of such carrier is shortened. This is considered due to so-called filming phenomenon by adhesion of the wax component in the toner to the surface of the carrier particles. Reason for the occurrence of the toner filming is considered to reside in the the fact that it is necessary to increase the content of such wax in the toner in order to attain sufficient off-set prevention effect, and in addition, since the dispersion capability of the resin of such wax is relatively low and the domain of the wax becomes too large, the wax is considered to be present in the toner resin in a separate phase.

OBJECT OF THE INVENTION

The present invention has been made under such background of the art and the object of the invention is to provide a toner for developing an electrostatic latent image which has a low minimum fixing temperature, sufficient offset prevention property and good fluidity with less aggregation, which is capable of stably producing visual toner images of good image quality for the long repetition of copying performance, and which is suitably used for the rapid fixing process.

SUMMARY OF THE INVENTION

The present invention specifically relates to toner for developing an electrostatic latent image which comprises (a) a polyester resin of a non-linear copolymer having, as its side chain, an aliphatic hydrocarbon group containing therein 3 to 22 carbon atoms, said copolymer being obtained from polymerization of an etherified bisphenol monomer, a di-carboxylic acid monomer, and a polyhydric alcohol of trihydric or more and/or a monomer component containing a polycarboxylic acid monomer of tricarboxylic acid or more carboxylic or more, and at least one compound selected from the group consisting of (b) an alkylene-bis-aliphatic acid amide compound represented by the general formula;

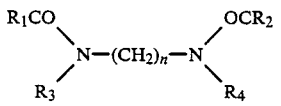

wherein $R_1$ and $R_2$ are independently selected from saturated or unsaturated aliphatic hydrocarbon groups having not less than 10 carbon atoms, $R_3$ and $R_4$ are independently selected from a hydrogen atom and a group represented by $—OCR_5$ wherein $R_5$ is a saturated or unsaturated hydrocarbon group and n is a positive integer and (c) a wax containing not less than 20% by weight of ester component, the needle penetration degree of wax being not more than 4.

DETAILED DESCRIPTION OF THE INVENTION

The monomer components used for the synthesis of the non-linear polyester resin which constitutes the binder resin of toner of the present invention are as follows: (i) a diol monomer containing as the main constituent thereof an etherified bisphenol and dicarboxylic acid monomer, which monomers constitute the main structure of the copolymer; (ii) a polyhydric alcohol monomer of trihydric or more and/or a polycarboxylic acid monomer of tri-carboxylic or more, which monomers function for the non-linearization of the copolymer, i.e., forming of a branched or a network structure; and (iii) a polyhydric alcohol monomer of diol or more containing a saturated or unsaturated hydrocarbon group having 3 to 22 carbon atoms and/or a polycarboxylic acid monomer of dicarboxylic acid or more containing a saturated or unsaturated hydrcarbon group having 3 to 22 carbon atoms, either of which monomers is capable of forming a side chain containing a hydrocarbon group having 3 to 22 carbon atoms.

If necessary, other monomers than those mentioned hrerinbefore may also be used in the present invention within the range which does not jeopardize the advantages of the present invention.

As for the etherified phenols, as defined in (i) above, for example, polyoxypropylene(2.2)-2,2-bis(4-hydroxyphenyl)propane, polyoxyethylene(2)-2,2-bis(4-hydroxyphenyl)propane, polyoxypropylene(6)-2,2-bis(4-hydroxyphenyl)propane, polyoxyproptrene(1.3)-2,2-bis(4-hydroxyphenyl)propane may be mentioned.

As for other diols, for example, ethylene glycol, diethylene glycol, triethylene glycol, 1,2-propylene glycol, 1,3-propylene glycol, 1,4-butanediol, neopentyl glycol, 1,4-butenediol; 1,4-bis(hydroxymethyl)cyclohexane; and other bisphenols such as bisphenol A and hydrgenated bisphenol A may be mentioned.

As for xamples of dicarboxylic acid monomers, maleic acid, fumaric acid, metaconic acid, citraconic acid, itaconic acid, glutaconic acid, phthalic acid, isophthalic acid, terephthalic acid, cyclohexane-di-carboxylic acid, succinic acid, adipic acid, sebacic acid, malonic acid and anhydride thereof, and other dibasc acid monomers may be mentioned. The proportion of these acid monmers to be used is, preferably, within the range from 10 to 90 molar % and, more preferably, within the range from 20 to 60 molar % with respect to the total acid component.

Further as for the polyhydric alcohol monomer defined in (ii) above, for example, sorbitol, 1,2,3,6-hexanetetraol, 1,4-sorbitan, pentaerythritol, di-pentaerythritol, tripentaerythritol, saccharose, 1,2,4-butanetriol, 1,2,5-pentanetiol, glycerol, 2-methylpropanetriol, 2-methyl-1,2,4-butanetriol, trimethylol ethane, trimethylol propane and 1,3,5-trihydroxymethyl benzene and the like may be mentioned. The amount of the polyhydric alcohol to be used is, preferably, within the range from 5 to 50 molar % and, more preferably, 10 to 40 molar % with respect to the total alcohol component. In the case the proportion exceeds 50 molar %, there will be a tendency that the fixability of the toner becomes insufficient, and at the proportion less than 5%, the non-linearization being insufficient, and the off-set prevention property of the toner will be reduced.

As for the polycarboxylic acid monomer of tricarboxylic or more, for example, 1,2,4-benzenetricarboxylic acid, 1,2,5-benzene tricarboxylic acid, 1,2,4-cyclohexanetricarboxylic acid, 2,5,7-naphthalenetri-carboxylic acid, 1,2,4-naphthalenetricaboxylic acid, 1,2,4-butanetricaboxylic acid, 1,2,5-haxanetricaboxylic acid, 1,3-dicarboxyl-2-methyl-2-methylenecarboxylic-propane, tetra(methylenecalboxylic)methane, 1,2,7,8-octane-tetracarboxylic acid, empol trimer acid, and acid anhydride of heretofore-mentioned organic acids can be mentioned.

It is preferable in the present invention that the proportion of the polyhydric alcohol to be used is within the range from 5 to 50 molar % and, more preferably within the range from 10 to 40 molar % with respect to the total acid component. In the case the proportion exceeds 50 molar %, there will be a tendency that the fixability of the toner becomes insufficient, and at the proportion less than 5%, the non-linearization being insufficient, and the off-set prevention property of the toner will be reduced.

As for examples of the polyhydric alcohol as defined in (iii) above, those compounds as listed in (i) or (ii) above may be used. Especially, n-dodecenyl succinic acid, isododecenyl succinic acid, n-dodecyl succinic acid, isododecyl succinic acid, iso-octyl succinic acid, n-octyl succinic acid, n-butyl succinic acid and the like may be mentioned as the preferable compounds. The total proportion of these polyhydric alcohol monomer and polycalboxylic acid monomer containing the hydrcarbon group is within the range from 1 to 50 molar % and, more preferably, 1 to 30 molar % with respect to the total monomer components. In the case the proportion exceeds 50 molar %, there will be a tendency that the aggregation preventive property of the toner becomes insufficient, and at the proportion less than 5%, fixability of the toner at low temperatue becomes insufficient.

The representative examples of the alkykene-bis-aliphatic acid amide represented by the general formula, which is used in the present invention are given below:

$C_{10}H_{21}CO-NH-(CH_2)_5-NH-OCC_{10}H_{21}$ 1.

$C_{11}H_{23}CO-NH-(CH_2)_4-NH-OCC_{11}H_{23}$ 2.

$C_{13}H_{27}CO-NH-(CH_2)_2-NH-OCC_{13}H_{27}$ 3.

$C_{10}H_{21}CO-NH-(CH_2)_3-NH-OCC_{14}H_{29}$ 4.

$C_{15}H_{31}CO-NH-(CH_2)_2-NH-OCC_{15}H_{31}$ 5.

$C_{17}H_{35}CO-NH-CH_2-NH-OCC_{15}H_{31}$ 6.

$C_{17}H_{35}CO-NH-(CH_2)_2-NH-OCC_{15}H_{31}$ 7.

$C_{23}H_{47}CO-NH-CH_2-NH-OCC_{15}H_{31}$ 8.

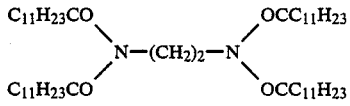

9.

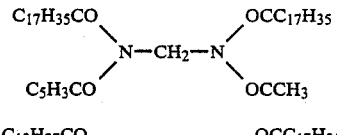

10.

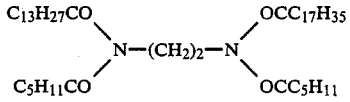

11.

$C_{21}H_{41}CO-NH-CH_2-NH-OCC_{21}H_{41}$ 12.

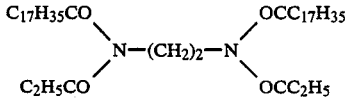

13.

$C_{17}H_{35}CO-NH-(CH_2)_2-NH-OCC_{17}H_{31}$ 14.

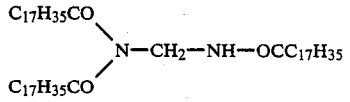

15.

As for alkylene bis-aliphatic acidamide compounds available in the market, the followings may be mentioned.

"BISAMIDE" (Nitto Chemical Ind., Co., Ltd.),
"PLASTFLOW" (Nitto Chemical Ind., Co., Ltd),
"DIADD 200BIS" (Nippon Hygrogen Co., Ltd.),
"LUBRON E" (Nippon Hydrogen Co., Ltd.),
"ALFLOW H50S" (Nippon Oil and Fats Co., Ltd.),
"ALFLOW V-60" (Nippon Oil and Fats Co., Ltd.),
"AMIDE 6-L" (Kawaken Fine Chemical Co.),
"AMIDE 7-S" (Kawaken Fine Chemicak Co.),
"ARMOWAX-EBS" (Lion-Armer Co.,),
"Hoechst Wax C" (Hoechst),
"Nobuko Wax-22DS" (Nobuko Chemical Co.,),
"Adva Wax-280" (Advance Co.,),
"Kao Wax-EB" (Kao Soap Co., Ltd.),
"Parycin-285" (Baker-Caster Oil Co.,)

The alkylene bis-aliphatic acidamide compound of the formula generally has an increased softening point with the increase of the number of carbon atoms in the hydrocarbon group or of the length of the alkylene chain contained in the molecule. In view of the heating temperature to be applied during the manufacture of the toner and intended lowering of the fixing temperature thereof, those having the softening point of 100° to 180° C., and more preferably, those having the softening temperature of 130° to 160° C. are advantageously used in the present invention. For this reason, it is preferred that n in the general formula be not more than 5.

The preferable proportion of the amount of the compound as the mold releasing agent to be contained in the toner conposition is within the range of 1 to 20% by weight relative to the binder resin and, more preferably, within the range of 1 to 10% by weight. When the proportion to be contained is less than 1%, there will atendency that the effect of compound as the mold releasing agent is hardly exerted and, accordingly, offset prevention effect may be weakened and the effect of lowering the minimum fixing temperature may not be obtained. When, on the other hand, the proportion exceeds 20% by weight, the fluidity of the toner is likely to degrade, causing degrading of good developability and transferability of the toner, thus to make the good image formation difficult. Further, excess addition of the mold releasing tends to cause adhesion of the mold releasing agent to the sleeve in the developing unit or to the electrostatic latent image-bearing support (i.e., photoreceptor, etc.), and thus to hinder the exertion of the normal function of the toner.

The compound (c) used in the present invention contains as a component thereof an ester at a proportion of more than 20% by weight, together with other component such as higher fatty acids, higher alcohols or hydrocarbons, which may optionally be contained therein, and the needle penetration degree of which is not more than 4.

It is preferable in the present invention that such compound is selected from waxes having a melting point of between 60° and 110° C.

In the present invention the needle penetration degree is a value obtained in accordance with the measuring method described in JIS K2235-1980. That is to say, a sample wax which is heated and melted is taken in a sample container and, after the sample is left and cooled down, the sample is kept constant in its temperature at 25° C. in a water bath. A needle the total mass of which is fixed to be 100 g is then penetrated vertically into the sample wax for 5 minutes, and the depth of the needle thus penetrated is measured to the precision of 0.1 mm. The value of the needle penetration degree of the invention is defined as the value obtained by multiplying the depth by 10.

The melting point of the resin can be obtained by Differential Scanning Calorimetory (DSC), i.e., the peak fusion value of the sample, when a few mg of sample was heated at a constant temperature rising rate of 10° C./min, is taken as the melting point.

Some representative examples of the wax of this class are given below:

| Mold Releasing Agent | Ester Component Kind | Ester Component Content (% by weight) | Needle Penetration Degree | Melting Point (°C.) |
|---|---|---|---|---|
| Carnauba Wax No.1 (Noda Wax Co.) | Ester of Fatty Acid | 80–85 | below 1 | 84 |
| Candelilla Wax (Special) (Noda Wax Co.) | Ester of Fatty Acid | 24–30 | 1 | 66 |
| Candelilla Wax No.1 (Noda Wax Co.) | Ester of Fatty Acid | 24–30 | 2 | 64 |
| Candelilla Wax No.2 (Noda Wax Co.) | Ester of Fatty Acid | 24–30 | 2 | 64 |
| Hoechst Wax E (Hoechst Japan Co.) | Ethylene Glycol Ester of Montanic | above 50 | 1 | 78 |

-continued

| Mold Releasing Agent | Ester Component Kind | Content (% by weight) | Needle Penetration Degree | Melting Point (°C.) |
|---|---|---|---|---|
| Hoechst Wax OP(Hoechst Japan Co.) | Acid Partially Saponified Butylene Glycol Ester of Montanic Acid | above 50 | 1 | 79 |
| Kao Wax 85P (Kao Soap Co.) | Glycerol-tril2-hydroxy Stearate | above 80 | 2 | 83 |
| Hohoba Solid Wax (Noda Wax Co.) | Ester of Unsaturated Alcohol and Unsaturated Acid | 97 | 2 | 68–78 |

The preferable proportion of the the wax to be contained in the present invention is within the range of 1 to 20% by weight relative to the binder resin and, more preferably, within the range of 1 to 10% by weight. If the proportion to be contained is less than 1%, the effect as the mold releasing agent is hardly exerted and, accordingly, off-set prevention effect and good fixability at low temperature of the toner may not be very effective. If, on the other other, the proportion exceeds 20% by weight the fluidity of the toner is likely to degrade, causing degrading of goog developability and transferability of the toner, thus to make the good image formation difficult. Further, excess addition of the mold releasing tends to cause adhesion of it to the sleeve in the developing unit or to the electrostatic latent image-bearing support (i.e., photoreceptor, etc.), and thus to hinder the exertion of the normal function thereof.

When the alkylene bis-aliphatic acidamide compound and the wax are used in combination the ratio of the alkylene bis-aliphatic acidamide compound against the wax is, in terms of the weight by part, preferably within the range from 0.5:1 to 10:1, and more preferably, from 0.5:1 to 5:1.

The toner of the present invention is in a fine powder form prepared by incorporating into and dispersing in the above-mentioned binder resin and the mold releasing agent and, if necessary, other additives for the improvement of the properties of the toner, such as colorant, magnetic material and the like. The average particle size of the toner is generally 5 to 30 microns.

As for the colorant usable in the present invention, any conventionally known colorants and such colorant includes carbon black, Nigrosine(C.I. No. 50415B), Aniline Blue(C.I. No. 50405), Ultranarine Blue(C.I. No. 77103), Chrome Yellow(C.I. No. 14090), Quiniline Yellow(C.I. No. 47005), Rose Bengal(C.I. No. 45435), Du Pont Oil Red(C.I. No. 26105), Phthalocyanine Blue(C.I. No. 74160), Lamp Black(C.I. No. 77266), etc. and a mixture thereof may be used. The amount of the colorant to be incorporated into the toner of the present invention may not be limited but, in general, 1 to 20 parts by weight relative to 100 parts of the binder resin may be preferable.

In the case where toner of the present invention is applied to a so-called one-component toner, a magnetic material may be incorporated into the toner composition instead of, or together with the colorants. The magnetic material that may be used includes a compound or an alloy containing therein a ferromagnetic element such as iron, cobalt and nickel; ferrite, magnetite; such an alloy as so-called Heusler's alloy which contains manganese and copper in the alloy, like Mn-Co-Al or Mn-Co-Sn, and whhich does not contain magnetic element but turns to show a ferromagnetic nature under suitable treatment by heat; or cromium dioxide, etc. may be mentioned.

These magnetic materials are usually incorporated into and uniformely dispersed in the the toner composition in the form of a fine powder of the average particle size of 0.1 to 1 micron. The amount of the magnetic material to be incorporated is generally 20 to 70 parts by weight relative to 100 parts by weight of toner and, preferably, at a proportion of 40 to 70 parts by weight relative to the same.

As for the other additives for improving other properties of the toner, for example, charge controlling agent, fluidity improving lubricants such as fine powdery silica and the like may be mentioned.

In addition to the polyester resin of the present invention, certain type of resin may be used for the purpose of improving various properties of the toner, for example, for preventing the occurrence of toner filming or for the purpose of improving pulverization property or chargeability of the toner. The resins to be preferably used for this purpose include, for example, polymers not having undergone cross-linking treatment and not containing chloroform-insoluble component. As for such resins, for example, homopolymers, copolymers or a mixture thereof obtained by polymerizing at least one of the following monomer may be mentioned: Styrenes such as styrene or para-chlorostyrene; vinyl naphtharene; vinyl esters such as vinyl chloride, vinyl bromide, vinyl fluoride, vinyl acetate, vinyl propionate, vinyl benzoate and vinyl butyrate; methylene aliphatic carboxylic acid esters such as methyl acrylate, ethyl acrylate, n-butyl acrylate, iso-butyl acrylate, dodecyl acrylate, n-octyl acrylate, 2-chloroethyl acrylate, phenyl acrylate, alpfa-chloromethehtyl acrylate methyl methacrylate, ethyl methacrylate, butyl methacrylte; acrylonitrile, methacrylonitrile; acrylamide; vinyl ethers such as vinyl methyl ether, vinyl iso-butyl ether or vinyl ethyl ether; vinyl ketones such as vinyl methyl ketone or vinyl hexyl ketone; N-vinyl compound such as N-vinyl pyrrole, N-vinyl carbazole, N-vinyl indole or N-vinyl pyrrolidone and the like compounds. Further non-vinyl thermo plastic resins such as a rhosin-modified a phenol-formalin resin, an oil-modified epoxy resin, a polyurethane resin, a cellulose resin or a polyether resin, or a mixture of these nonvinyl resin and a heretofore mentioned vinyl resin may also be used. The amount of these resins to be incorporated into the toner composition in not limited unless such incorporation jeopartize the effect of the present invention, however, 30% by weight with respect to the total binder resin may be preferable.

EFFECTS OF THE PRESENT INVENTION

With the use of the toner of the present invention following technical advantages can be expected.

(i) Minimum fixing temperature can be lowered and practical fixing temperature range may be widened.

(ii) Improved off-set and winding prevention effects can be obtained.

(iii) Toner having improved fluidity and and copying durability can be obtained.

(iv) Even in the recycling system, toner image with a stable image quality can be obtained.

(v) Contamination due to the adhesion of the toner to carrier, photo-receptor or sleeve will be reduced.

(vi) Because of good fluidity of the toner the use of fluidity-improving agent such as powdery silica may be decreased or omitted and, therefore, disadvantages with the use of the silica such as the damage of the photoreceptor can be reduced or eliminated.

And thus according to the present invention toner images with sufficient high density will be obtainable at relatively low temperature, without causing off-set phenomenon, at high speed and stably when the copying is repeated for a long time.

The present invention is further explained with reference to Examples, however, the scope of the invention is not limited by them.

In the Examples the binder resins and the mold releasing agents used are as follows:

PREPARATION OF A BINDER RESIN

(1) Binder Resin A

| | |
|---|---|
| Polyoxypropylene(2.2)-2,2-bis(4-hydroxyphenyl)propane | 700 g |
| Fumaric acid | 150 g |
| n-Dodecenyl succinic acid anhydride | 55.4 g |
| Hydroquinone | 0.1 g |

A round bottomed flask equipped with a thermometer, a stainless steel stirrer, a glass tube through which to introduce nitrogen and a condenser was charged with the above-mentioned composition. The flask was set in a mantle heater and heated to 250° C. while nitrogen gas was introduced into the flask to keek its interior under an inert atomosphere. Then, the reaction was carried out while stirring the composition. At the time when water, which is formed by the the reaction, stopped flowing out the acid value was measured to be 1.5.

65.4 g of 1,2,4-benzene tricarboxylic acid anhydride was added to the reaction product and further reaction was carried out for 8 hours and the reaction was finished when the acid value was 20. The softening point of the thus obtained polyester resin in accordance with the Ball and Ring Method(by JIS K2531-1960) was 120° C.

This polyester resin is designated as Binder Resin A.

(2) Binder Resin B

| | |
|---|---|
| Polyoxyethylene(2)-2,2-bis(4-hydroxyphenyl)propane | 650 g |
| Fumaric acid | 120 g |
| iso-Decenyl succinic acid anhydride | 55.4 g |

The above composition was reacted at 200° C. using the same apparatus as in the case of Resin A. The reaction was terminated when the softening point of the reaction product was 120° C.

This polyester resin was designated as Binder Resin B.

(3) Binder Resin C(For Comparison)

| | |
|---|---|
| Polyoxypropylene(2.2)-2,2-bis(4-hydroxyphenyl) propane | 211 g |
| Terephthalic acid | 299 g |
| Pentaerythritol | 82 g |

The above composition was heated using the same apparatus as in the case of Resin A, and thereto 0.05 g of dibutyl tin oxide was added and the reaction was carried out at 200° C. The reaction was terminated when the softening point by the Ball and Ring Method was 131° C. Thus obtained polyester resin was designated as Binder Resin C.

Mold Releasing Agent a1
"HOECHST WAX C" (HOECHST JAPAN Co.)
Mold Releasing Agent a2
Alkylene bis-aliphaticacidamide
"BISAMIDE" (Nitto Chemical Ind., Co., Ltd.)
Mold Releasing Agent a3
Alkylene bis-aliphaticacidamide
"ARMOWAX-EBS" (Lion-Armer Co., )
Mold Releasing Agent a4
Alkylene bis-aliphaticacidamide
"HOECHST WAX C" (HOECHST JAPAN Co.)
Mold Releasing Agent b1
"Carnauba Wax No. 1" (Noda Wax Co.)
Mold Releasing Agent b2
"Candelilla Wax" (Noda Wax Co.)
Mold Releasing Agent c1
Low molecular polypropylene
"Viscol 660P" (Sanyo Chemical Co.)
Polyolefin Wax, Needle Penetration Degree(N.P.D.) = 1.5; Melting Point(m.p.) = 142° C.
Mold Releasing Agent c2
"Hi-Wax 400P" (Mitsui Petrochemical Co.)
Low molecular polyethylene Wax
Mold Releasing Agent c3
Synthesized Wax(Aliphatic acid ester content of 10% by weight, N.P.D. = 1 and m.p. = 64° C.)
Mold Releasing Agent c4
"HOECHST WAX GL-3" (HOECHST JAPAN Co., a parafin wax, N.P.D = 1, m.p. = 74° C.)
Mold Releasing Agent c5
"Rice Wax F-1" (Noda Wax Co., aliphatic acidester containing wax, ester content; 93–96% by weight, N.P.D. = 6, m.p. = 79° C.)

In the following Examples, the toner components shown in TABLE 1 were mixed and neaded in a extruder, the temperature of the inside thereof having been fixed to the one which is below the softening point of the resin used by 10° C. Then the mixture was cooled down by water, pulverized and classified to obtain a toner having the average particle size of 11 microns. Finally 0.8% by weight of hydrophobic silica was added to the thus prepared tone, to prepare the toner of the Examples. In TABLE 1 the numerals in the brackets are given in terms of parts by weight.

TABLE 1

| Example No. | Binder | Mold Releasing Compound of the Invention | | Other Wax Used | Carbon Black |
|---|---|---|---|---|---|
| Present Invention | | | | | |
| 1 | A (100) | a1 (3) | — | — | MOGAL L (Cabbot Co.) (10) |
| 2 | A (100) | a1 (6) | — | — | MOGAL L (Cabbot Co.) (10) |
| 3 | A (100) | a2 (3) | — | — | MOGAL L (10) |
| 4 | A (100) | a3 (3) | — | — | MOGAL L (Cabbot Co.) (10) |
| 5 | B (100) | a1 (3) | — | — | MOGAL L (Cabbot Co.) (10) |

TABLE 1-continued

| Example No. | Binder | Mold Releasing Compound of the Invention | | Other Wax Used | Carbon Black |
|---|---|---|---|---|---|
| 6* | A (48) | a1 (3) | — | — | MOGAL L (Cabbot Co.) (10) |
| 7 | A (100) | — | b1 (3) | — | MOGAL L (Cabbot Co.) (10) |
| 8 | A (100) | | b1 (6) | — | MOGAL L (Cabbot Co.) (10) |
| 9 | A (100) | — | b2 (3) | — | MOGAL L (Cabbot Co.) (10) |
| 10 | B (100) | — | b1 (3) | — | MOGAL L (Cabbot Co.) (10) |
| 11* | A (48) | — | b1 (3) | — | MOGAL L (Cabbot Co.) (10) |
| 12 | A (100) | a4 (2) | b1 (2) | — | MOGAL L (Cabbot Co.) (10) |
| 13 | A (100) | a4 (6) | b1 (2) | — | MOGAL L (Cabbot Co.) (10) |
| 14 | A (100) | a3 (2) | b1 (2) | — — | MOGAL L (Cabbot Co.) (10) |
| 15 | A (100) | a4 (2) | b2 (2) | — | MOGAL L (Cabbot Co.) (10) |
| 16 | A (100) | a3 (2) | b2 (2) | — | MOGAL L (Cabbot Co.) (10) |
| 17 | B (100) | a4 (2) | b1 (2) | — | MOGAL L (Cabbot Co.) (10) |
| 18* | A (48) | a4 (2) | b1 (2) | — | MOGAL L (Cabbot Co.) (10) |
| Comparison | | | | | |
| 1 | A (100) | — | — | c1 (3) | MOGAL L (Cabbot Co.) (10) |
| 2 | A (100) | — | — | c2 (3) | MOGAL L (Cabbot Co.) (10) |
| 3 | C (100) | — | — | c1 (3) | MOGAL L (Cabbot Co.) (10) |
| 4 | A (100) | — | — | — | MOGAL L (Cabbot Co.) (10) |
| 5 | A (100) | — | — | c3 (3) | MOGAL L (Cabbot Co.) (10) |
| 6 | A (100) | — | — | c4 (3) | MOGAL L (Cabbot Co.) (10) |
| 7 | A (100) | — | — | c5 (3) | MOGAL L (Cabbot Co.) (10) |
| 8 | C (100) | — | b1 (2) | — | MOGAL L (Cabbot Co.) (10) |
| 9 | C (100) | — | b1 (2) | a4 (2) | MOGAL L (Cabbot Co.) (10) |

In TABLE I, toners of Examples 6, 11 and 18 are so-called one-component developer and the respective toners contain, in addition to the component listed in the table, 52 parts by weight of fine powder of magnetic material "BL-100" (Titane Industry Co.) and 1 part by weight of a nigrosine dye as the charge controlling agent, "Nigrosine Base EX" (Orient Chemical Co.).

Thus obtained toners according to the present invention (Toners 1 to 18) and the toners for comparison (Comparative Toners 1 to 9) were subjected to various tests explained below:

First, making use of the nature of the powder that the higher the fluidity of a powder is, the smaller is the condensation rate of the powder, the bulk density of the respective toners were measured in order to determine the fluidity of the toners. The respective toners were poured down into a container having a diameter of 28 mm and the total volume of 100 ml to its full through a sieve of 100 mesh and the weight was measured.

The respective toners, except toners in Examples 6,11 and 18, were mixed with a resin coated carrier to prepare as many developers, of which toner content was 2% by weight respectively.

Thus prepared developer was subjected to an image formation test using a electrophotographic copying machine "U-Bix 4500" (product of Konishiroku Photo Industry Co., Ltd.), in which so-called toner recycling system is employed, and 60000 times of repeated copying tests were carried out to determine developability of the electrstatic latent image, transferability of the developed toner image to the transfer sheet and fixability with the use of heat roll fixing unit of the toner, and the toner density of the copied image of the first and after 60000th copies were measured.

After 60000 times of copying test, the bulk density of the toner, extent of contamination on the surface of the carrier particles, photosensitive drum and developing sleave in the development unit were also observed.

Further the minimum fixing temperature, the minimum off-set occurring temperature and winding occurring temperature were measured.

As to the minimum fixing temperature, fixing test by the use of a heat roll fixing unit consisting of a heat roll, the surface of which is formed of TEFLON (polytetrafluoroethylene produced by du Pont), and a pressure roll, the surface of which is formed of a silicone rubber "KE-1300 RTV" (product of Shinetsu Chemical Industry Co., Ltd.), was carried out by passing through the fixing unit a sample transfer sheet, onto which 64 g/m$^2$ of toner has been adhered, at a line feeding speed of 200 mm/sec, and this procedure was repeated while increasing stepwise the temperature of the heat roll by 5° C. from 100° C. The fixed toner image thus obtained was subjected to rubbing test with KIM wiper and the minimum fixing temperature was determined as the lowest temperature at which the fixed toner image has a sufficient durability against rubbing.

Incidentally, the fixing unit used does not have a silicone oil providing device.

The lowest temperature at which off-set phenomenon is first observed was determined in the similar manner as in the determination of the minimum fixing temperature, that is, the temperature at which the off-set phenomenon is first observed was measured by, first, developing an electrostatic image formed in an ordinary electrophotographic method with a developer and, transferring the toner image onto a plain paper sheet and fixing the transferred image in the abovementioned fixing unit, and, thereafter, by passing a white paper through the fixing unit under the same conditions, to observe if any contamination is seen on the surface of the white paper due to the toner attached to the roll in the fixing unit. By repeating above-mentioned operation at various temperatures, the temperature, at which off-set phenomenon is first seen was obtained.

Still further, winding occurrence temperature was measured by the use of a uniformly black original, whereby toner was attached to the whole surface of the transfer sheet by development and transfer processes, and by carrying out fixing test while lowering stepwise the temperature of the heat roll of the fixing unit.

Results of the tests are shown in TABLES 2 and 3 below.

TABLE 2

| Sample. No. | Minimum Fixing Temperature (°C.) | Minimum Off-set Ocurring Temperature (°C.) | Winding Occurrence Temperature (°C.) |
|---|---|---|---|
| Toner of the Invention | | | |
| 1 | 150 | 240 | 170 |
| 2 | 140 | above 240 | 160 |
| 3 | 150 | 240 | 170 |
| 4 | 150 | 240 | 170 |
| 5 | 150 | 240 | 170 |
| 6 | 160 | above 240 | 170 |
| 7 | 140 | 240 | 150 |
| 8 | 130 | 240 | 140 |
| 9 | 140 | 240 | 150 |
| 10 | 140 | 240 | 150 |
| 11 | 150 | 240 | 160 |
| 12 | 140 | 240 | 150 |
| 13 | 130 | above 240 | 140 |
| 14 | 140 | 240 | 150 |
| 15 | 140 | 240 | 150 |
| 16 | 140 | 240 | 150 |
| 17 | 140 | 240 | 150 |
| 18 | 150 | above 240 | 150 |
| Comparative Toner | | | |
| 1 | 160 | 240 | 180 |
| 2 | 160 | 240 | 180 |
| 3 | 160 | above 240 | 180 |
| 4 | 280 | 200 | 210 |
| 5 | 140 | 240 | 170 |
| 6 | 140 | 240 | 170 |
| 7 | 140 | 240 | 170 |
| 8 | 160 | 240 | 170 |
| 9 | 160 | 240 | 150 |

TABLE 3

| Sample No. | Bulk Density (g/cc) | | Image Density | | Degree of Contamination |
|---|---|---|---|---|---|
| | Initial | After 60000 copies | Initial | After 60000 copies | |
| Toner of the Invention | | | | | |
| 1 | 0.46 | 0.44 | 1.34 | 1.33 | Without |
| 2 | 0.45 | 0.42 | 1.33 | 1.30 | Without |
| 3 | 0.45 | 0.44 | 1.34 | 1.32 | Without |
| 4 | 0.45 | 0.43 | 1.34 | 1.31 | Without |
| 5 | 0.46 | 0.44 | 1.34 | 1.31 | Without |
| 6 | 0.78 | — | — | — | — |
| 7 | 0.44 | 0.42 | 1.34 | 1.32 | Without |
| 8 | 0.43 | 0.40 | 1.32 | 1.30 | Without |
| 9 | 0.44 | 0.42 | 1.34 | 1.33 | Without |
| 10 | 0.44 | 0.42 | 1.33 | 1.32 | Without |
| 11 | 0.77 | — | — | — | — |
| 12 | 0.44 | 0.42 | 1.34 | 1.32 | Without |
| 13 | 0.43 | 0.41 | 1.33 | 1.30 | Without |
| 14 | 0.44 | 0.42 | 1.34 | 1.31 | Without |
| 15 | 0.44 | 0.42 | 1.34 | 1.32 | Without |
| 16 | 0.44 | 0.42 | 1.34 | 1.31 | Without |
| 17 | 0.44 | 0.42 | 1.34 | 1.31 | Without |
| 18 | 0.77 | — | — | — | — |
| Comparative Toner | | | | | |
| 1 | 0.40 | 0.37 | 1.18 | 0.97 | Observed |
| 2 | 0.40 | 0.37 | 1.16 | 0.97 | Observed |

TABLE 3-continued

| Sample No. | Bulk Density (g/cc) | | Image Density | | Degree of Contamination |
|---|---|---|---|---|---|
| | Initial | After 60000 copies | Initial | After 60000 copies | |
| 3 | 0.46 | 0.44 | 1.33 | 1.31 | Without |
| 4 | 0.46 | 0.45 | 1.34 | 1.33 | Without |
| 5 | 0.40 | 0.37 | 1.18 | 0.97 | Observed |
| 6 | 0.39 | 0.37 | 1.16 | 0.95 | ' Extensively Observed |
| 7 | 0.44 | 0.32 | 1.32 | 0.90 | Extensively Observed |
| 8 | 0.44 | 0.42 | 1.33 | 1.31 | Without |
| 9 | 0.44 | 0.42 | 1.33 | 1.31 | Without |

As apparent from TABLES 2 and 3, the toner of the present invention has higher off-set and winding prevention ability, fixability at reduced temperature, excellent developability with sufficient density and excellent stability in image formation after long time repetition of copying in comparison with the toner of the prior art. Further no serious contamination in the sleeve of the developing unit or in the surface of the photoreceptor was observed even after 60000 times of copying.

Further, by the use of toner of the present invention, having the lower minimum fixing temperature, the transfer sheet need not be exposed to high temperature. Thus the the ccurrence of creases can effectively be be prevented, which is especially advantageous when both surfaces of the transfer paper sheet are to be used for copying.

In contrast thereto the comparative toner shows lower off-set coccurring temperature, inferior image quality and inferior stability in the image formation.

Further it is apparent from the TABLES that overall exellent copying performance can be obtained when the mold releasing agent of the present invention is used in combination with the case where the second or third molod releasing agent is used singly together with the resin of the present invention.

We claim:

1. In a process of developing a latent electrostatic image with a toner, then transferring and fixing the developed image and wherein the fixing is accomplished by the use of a fixing unit having a heat roll fixing unit comprising a fluorinated resin surface and a pressure roller, the improvement wherein the toner comprises (a) a non-linear copolymer polyester resin having a side chain, said side chain comprising an aliphatic hydrocarbon group containing 3 to 22 carbon atoms, said copolymer being obtained by polymerization of (i) an etherified bisphenol monomer, (ii) a dicarboxylic acid monomer, (iii) at least one of a polyhydric alcohol monomer containing at least 3 hydroxy groups and a monomer component containing a polycarboxylic acid containing at least 3 carboxy groups and (iv) at least one monomer which forms said side chain selected from the group consisting of polyhydric alcohol monomers containing at least 2 hydroxy groups and containing a saturated or unsaturated hydrocarbon group containing 3 to 22 carbon atoms and polycarboxylic acid monomers containing at least 2 carboxy groups and containing a saturated or unsaturated hydrocarbon group containing 3 to 22 carbon atoms; and at least one compound selected from the group consisting of (b) and an alkylene-bis-aliphatic acid amide compound represented by the formula

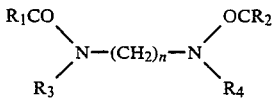

wherein $R_1$ and $R_2$ are independently selected from the group consisting of saturated and unsaturated aliphatic hydrocarbon groups having not less than 10 carbon atoms, $R_3$ and $R_4$ are independently selected from a hydrogen atom and a group represented by $-OCR_5$ wherein $R_5$ is a saturated or unsaturated hydrocarbon group and n is a positive integer, and (c) a wax containing not less than 20% by weight of an ester component, said wax having a needle penetration degree of not more than 4.

2. The process of claim 1, wherein the proportion of said dicarboxylic acid monomer with respect to the total acid component is from 10 to 90 molar %.

3. The process of claim 2, wherein said proportion of said dicarboxylic acid monomer is from 20 to 60 molar %.

4. The toner of claim 3, wherein said polyhydric alcohol monomer is selected from the group consisting of sorbitol, 1,2,3,6-hexanetetraol, 1,4-sorbitan, pentaerythritol, di-pentaerythritol, tripentaerythritol, saccharose, 1,2,4-butanetriol, 1,2,5-pentanetiol, glycerol, 2-methylpropanetriol, 2-methyl-1,2,4-butanetriol, trimethylol ethane, trimethylol propane and 1,3,5-trihydroxymethyl benzene.

5. The process of claim 1, wherein the proportion of said polyhydric alcohol monomer with respect to the total alcohol component is from 5 to 50 molar %.

6. The process of claim 5, wherein said proportion of said polyhydric alcohol is from 10 to 40 molar %.

7. The process of claim 1, wherein said polycarboxylic acid monomer is selected from the group consisting of 1,2,4-benzenetricarboxylic acid,
1,2,5-benzene tricarboxylic acid,
1,2,4-cyclohexanetricarboxylic acid,
2,5,7-naphthalenetricarboxylic acid,
1,2,4-naphthalenetricarboxylic acid,
1,2,4-butanetricarboxylic acid,
1,2,5-hexanetricarboxylic acid,
1,3-dicarboxyl-2-methyl-2-methylenecarboxylic-propane,
tetra(methylenecalboxylic)methane,
1,2,7,8-octane-tetracarboxylic acid, empol trimer acid, and the acid anhydride of said acids.

8. The process of claim 1, wherein the proportion of said polycarboxylic acid with respect to the total acid component is from 5 to 50 molar %.

9. The process of claim 8, wherein said proportion of said polycarboxylic acid monomer is from 10 to 40 molar %.

10. The process of claim 1, wherein the total proportion of said polyhydric alcohol monomer and said dicarboxylic or polycarboxylic acid monomer containing a hydrocarbon group is from 1 to 50 molar % with respect to the toal monomer components.

11. The process of claim 10, wherein said total proportion of said polyhydric alcohol monomer and said dicarboxylic or polycarboxylic acid monomer is from 1 to 30 molar %.

12. The process of claim 1, wherein n of said general formula is a positive integer from 1 to 5.

13. The process of claim 1, wherein said alkylene-bis-aliphatic acid amide compound is selected from the group consisting of

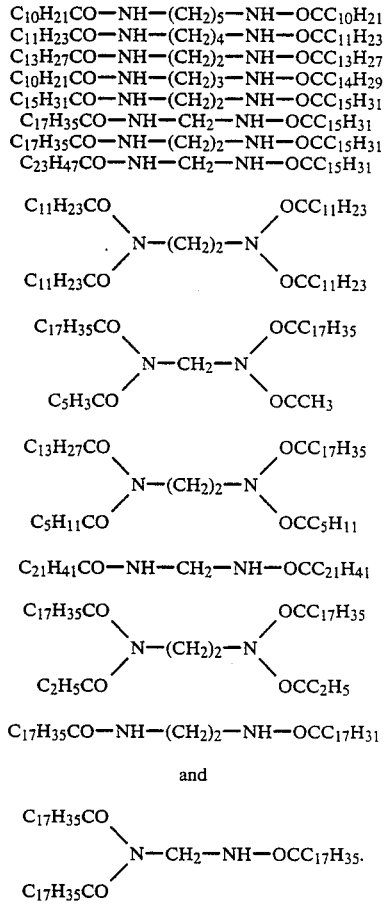

14. The process of claim 1, wherein said alkylene-bis-aliphatic acid amide compound has a softening point of 100° to 180° C.

15. The process of claim 14, wherein said alkylene-bis-aliphatic acid amide compound has the softening point of 130° to 160° C.

16. The process of claim 1, wherein said ester component of said wax is an ester of fatty acid or the partially saponified product of said ester.

17. The process of claim 1, wherein said wax has a melting point of between 60° and 110° C.

18. The process of claim 1, wherein the ratio of said alkylene-bis-aliphatic acid amide compound and said wax used in combination is from 0.5:1 to 10:1 by weight.

19. The process of claim 1, wherein said ratio of said alkylene-bis-aliphatic acid amide compound and said wax is from 0.5:1 to 5:1.

20. The process of claim 1, wherein said etherifide bisphenol monomer is selected from the group consisting of polyoxypropylene(2.2)-2,2-bis(4-hydroxyphenyl)propane,
polyoxyethylene(2)-2,2-bis(4-hydroxyphenyl)propane, polyoxypropylene(6)-2,2-bis(4-hydroxyphenyl)propane, and polyoxyproptrene(1.3)-2,2-bis(4-hydroxyphenyl)propane.

21. The process of claim 1, wherein said di-carboxylic acid monomer is selected from the group consisting of maleic acid, fumaric acid, metaconic acid, citraconic acid, itaconic acid, glutaconic acid, phthalic acid, isophthalic acid, terephthalic acid, cyclohexane-di-carboxylic acid, succinic acid, adipic acid, sebacic acid, malonic acid, n-dodecenyl succinic acid, iso-dodecenyl succinic acid, n-dodecyl succinic acid, iso-dodecyl succinic acid, iso-octyl succinic acid, n-octyl succinic acid, n-butyl succinic acid and the anhydrides of said acids.

* * * * *